US006472985B1

(12) United States Patent
Bruwer

(10) Patent No.: US 6,472,985 B1
(45) Date of Patent: Oct. 29, 2002

(54) SECURITY CONTROL SYSTEM

(76) Inventor: Frederick Johannes Bruwer, PO Box 3534, Paarl, 7620 (ZA)

( * ) Notice: Subject to any disclaimer, the term of this patent is extended or adjusted under 35 U.S.C. 154(b) by 0 days.

(21) Appl. No.: 09/807,221

(22) PCT Filed: Nov. 11, 1999

(86) PCT No.: PCT/ZA99/00120

§ 371 (c)(1),
(2), (4) Date: Apr. 11, 2001

(87) PCT Pub. No.: WO00/28499

PCT Pub. Date: May 18, 2000

(30) Foreign Application Priority Data

Nov. 11, 1998 (ZA) ..... 98/10293

(51) Int. Cl.[7] ..... G08B 13/00
(52) U.S. Cl. ..... 340/541; 340/426
(58) Field of Search ..... 340/541, 425.5, 340/426, 539, 825.69, 825.72; 49/25, 26

(56) References Cited

U.S. PATENT DOCUMENTS 4,125,826 A * 11/1978 Rasmussen et al. ..... 340/426
4,607,312 A 8/1986 Barreto-Mercado
4,808,995 A 2/1989 Clark et al.
4,833,449 A 5/1989 Gaffigan
5,459,448 A * 10/1995 Dortenzio et al. ..... 340/426
5,565,843 A 10/1996 Meyvis
5,576,701 A 11/1996 Heitschel et al.
5,729,199 A * 3/1998 Cooper et al. ..... 340/541
5,969,597 A 10/1999 Weigl et al.
6,100,793 A * 8/2000 Dimou ..... 340/426
6,127,922 A * 10/2000 Roddy et al. ..... 340/426

FOREIGN PATENT DOCUMENTS

DE 19735658 C 7/1998
EP 0440974 A 8/1991

* cited by examiner

*Primary Examiner*—John Tweel
(74) *Attorney, Agent, or Firm*—Jones Tullar & Cooper PC

(57) ABSTRACT

A security control system for use with a vehicle includes a transmitter on a vehicle, a receiver at a fixed installation which, in response to a signal from the transmitter, activates a device, a monitoring unit for monitoring the vehicle to detect authorized access to the vehicle, and an enabling device which is responsive to the monitoring unit, and wherein the transmitter is disabled unless enabled by the enabling device upon authorized access to the vehicle. The remote monitoring unit can also be linked to a second transmitter at the fixed installation for transferring status or other information to a receiver on the vehicle when the monitoring unit detects an event at the fixed installation. The receiver is linked to a display module in the vehicle for displaying the received information.

18 Claims, 1 Drawing Sheet

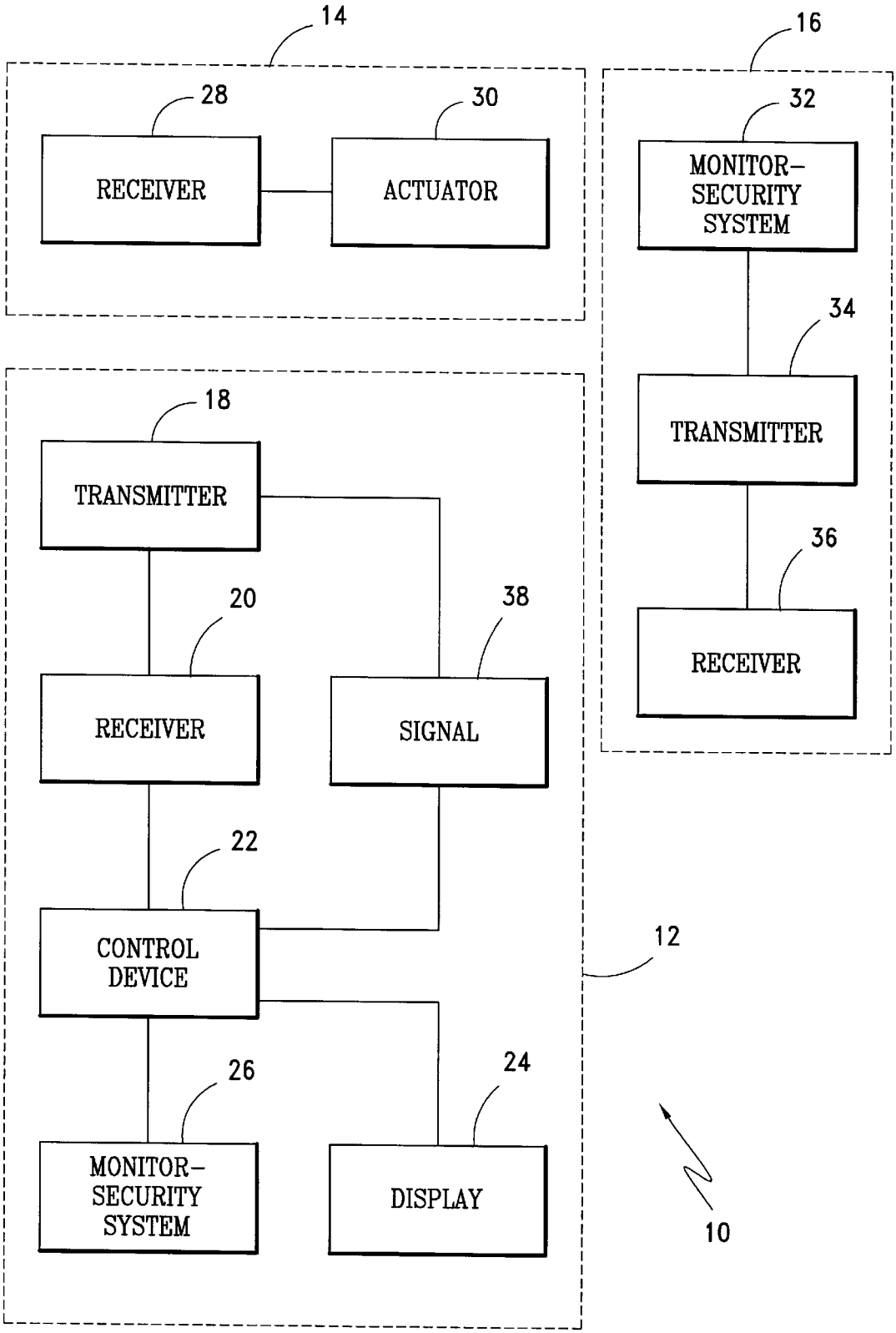
14
28
RECEIVER
30
ACTUATOR
16
32
MONITOR-SECURITY SYSTEM
34
TRANSMITTER
36
RECEIVER
18
TRANSMITTER
20
RECEIVER
38
SIGNAL
22
CONTROL DEVICE
12
26
MONITOR-SECURITY SYSTEM
24
DISPLAY
10

SECURITY CONTROL SYSTEM

BACKGROUND OF THE INVENTION

This invention relates generally to a security system and is more particularly concerned with control means for enhancing the effectiveness of a security system.

The use of radio transmitters in vehicles for the remote operation of doors and gates is widespread. A transmitter is used for transmitting a control signal, which is normally encoded, to a remote receiver. If the received signal is validated at the receiver an actuating mechanism is used to open a gate, or a door such as a garage door.

A recent development has been the mounting of the transmitter into a control panel or facia on a vehicle in an unobtrusive manner, substantially in the form of original equipment. For example a radio transmitter may be mounted in a sunvisor of a vehicle or in a housing in a door panel. This type of approach does result in a neat and attractive appearance and it becomes, for practical purposes, impossible to misplace a transmitter. On the other hand if the vehicle is stolen or if the transmitter is removed from the vehicle in which it is installed, in an unauthorised manner, it is possible for an intruder who is then in possession of the vehicle or transmitter to operate the respective gate or door, as the case may be, and so gain access to premises which are otherwise protected.

SUMMARY OF INVENTION

The invention provides a security control system which includes transmitter means for transmitting a control signal to a remote receiver, monitoring means for monitoring at least one installation to detect at least one designated event, signal generating means, responsive to the monitoring means for generating a first signal when a designated event is detected and inhibiting means responsive to the first signal, for inhibiting the transmission of the control signal.

The control system may include display means for displaying information relating to the monitoring means.

The designated event may be an unauthorized event, eg. theft from a vehicle or building, or unauthorised access to a vehicle or building. The designated event may otherwise be a permitted event, eg. a locking or enabling signal, which is used, at least, to change the mode of operation of the control system.

The installation which is monitored may vary according to requirement. For example at least one installation may be a vehicle and the monitoring means may monitor the vehicle to detect unauthorised access to the vehicle or the unauthorised removal of the transmitting means. If either of these events is detected then the transmission of the control signal is inhibited. Alternatively or additionally a security installation such as, for example, an intruder detection system at fixed premises eg. an apartment, house or office block, may be monitored and when an unauthorised event is detected, or when the nonoccurrence of a designated or authorized event is detected, then the said first signal is generated.

Conversely the transmitter means for transmitting the control signal to the remote receiver may only be enabled if access to the vehicle takes place in an authorised manner. Authorised access, in this sense, may include any specified occurrence or occurrences such as opening a door with a key, opening a door with a transmitted signal inputting a code for example via a keyboard to the monitoring means or any equivalent technique.

Thus, on the one hand the transmitter means or the said remote receiver may be rendered operative only when an authorised event is detected or, on the other hand, the transmitter means or the said remote receiver may be rendered inoperative when an unauthorised event is detected.

The said remote receiver may be used for actuating the movement of a door or a gate or for actuating any other apparatus or device.

The monitoring means may monitor more than one installation.

The monitoring means may monitor a building and this may be in place of, or in addition to, the monitoring of a vehicle.

It thus becomes possible, through the use of a suitable interlocking arrangement, to provide a signal on the display means which indicates the status of a security system in a building. If the security system has been breached then the operation of the control signal may be inhibited, or a signal indicating the type of breach may be transmitted to any appropriate party e.g. the lawful user, or owner, of the building.

For example: a car is fitted with a universal type transmitter located in its internal rear view mirror (such as the Homelink™ product by Prince). A gate or garage at the house of the vehicle's owner is fitted with a gate opener or a garage door opener (GDO) (such as a suitable Genie™ product). The vehicle is equipped with a remote keyless entry (RKE) system (based e.g. on the Keeloq™ system). According to the present invention, the transmitter inside the vehicle which would normally be programmed into the GDO system and then used to activate the gate or garage door opener, would be inhibited once the vehicle doors are locked with the RKE system and would only then reactivate upon reception of a valid command by the vehicle RKE system to open.

In a further enhancement the building may be fitted with an alarm system that will be capable of communicating its state such as an alarm condition to a control unit eg. installed in a car through any appropriate medium such as a wireless communication.

BRIEF DESCRIPTION OF THE DRAWING

The invention is further described by way of example with reference to the accompanying drawing which is a block diagram of a security control system according to one form of the invention.

DESCRIPTION OF PREFERRED EMBODIMENT

The accompanying drawing illustrates in block diagram form a security control system 10 according to the invention.

The system includes a control unit 12 which is enclosed in dotted outline and which, in use, is installed in or on a vehicle, a device 14 for operating a gate or door, according to requirement, eg. a garage door opener, and an intruder detection system 16.

The control unit 12 is installed, as original or semi-permanent equipment, in a vehicle, with suitable control buttons at unobtrusive positions inside the vehicle. The control buttons may for example be positioned on a rear side of a sunvisor, on a control plate in a door panel, or on any other surface or the like. These aspects are not important to an understanding of the invention. The control unit includes a transmitter 18, a receiver 20, a suitably programmed microprocessor-based control device 22, a display 24 and a monitor or security system 26.

The system 26 may be of any suitable kind which is known in the art. The system may be, or include a device, similar to the Homelink™ product referred to hereinbefore. The system 26 is used to protect the vehicle against theft, unauthorised access or the like. Typically, merely by way of example, the system 26 is responsive to the reception of an encoded signal and if the encoded signal is correctly identified the vehicle may be started and driven. The encoded signal may be generated in any appropriate way eg. by using an authorised, variable code, transmitter. On the other hand if unauthorised opening of a vehicle door takes place or if an attempt is made to start the vehicle without the correct encoded signal having been received then operation of the vehicle is inhibited in a variety of ways which are known in the art. More generally the system is enabled by an authorised event or events, and is disabled by one or more unauthorised events. As indicated in the preamble hereto the system 26 may be enabled when a vehicle is entered using an RKE system. If this system is not used then the transmitter is not able to generate a signal for reception by the receiver 28.

The operating device 14 includes a receiver 28 and an actuator 30. The actuator is also of a type which is known in the art and for example includes an electrical motor with a suitable control mechanism which is used for opening a door such as a door to a garage in which a vehicle may be housed. The invention is not limited in this regard and, generally, the actuator is any mechanism which is caused to operate upon receipt of a correct signal by the receiver.

The detection system 16 includes a monitoring arrangement 32 designed to detect unauthorised entry to premises, such as a house, in which the detection system 16 is installed. The system 16 may be of any appropriate kind and may be custom designed for the purpose. However it falls within the scope of the invention to make use of conventional, or already installed, systems such as commercially available house alarms or intruder detection systems. Such systems can easily be adapted, or retro-fitted, to be incorporated in or to work together with the security control system of the invention. The arrangement 32 interacts with a transmitter 34 and a receiver 36. The arrangement 32 is enabled, or disabled, when an encoded signal is received by the receiver 36 and is correctly identified. If the arrangement 32 is enabled and an unauthorised event takes place then the transmitter 34 is used in any appropriate way, for example to generate a warning signal or to summon assistance from a response service.

Referring again to the control unit 12 if a person gains unauthorised access to the vehicle in which the unit is installed or, more generally, carries out any unauthorised act, then this event is detected by the monitor system 26 which then activates the control device 22 to generate a signal 38 which inhibits operation of the transmitter 18. Thus the appropriate signal required to initiate the operation of the actuator 30 cannot be generated, and hence cannot be received by the receiver 28.

In a similar manner if the transmitter 18 is removed from the vehicle in which it is installed then the transmitter is not enabled unless authorised entry to the vehicle is gained. This however is not possible as the transmitter 18 or, more likely, the control unit 12, has been removed from the vehicle, for the monitor system does not detect authorised access or alternatively detects an unauthorised event. Once again the transmission of the signal by the transmitter 18, which is required to initiate operation of the actuator 30, is inhibited. The transmitter may be disenabled, in this way, using any suitable technique. For example a keyword or code, required to operate the transmitter, may be changed automatically if the transmitter is tampered with, in any way, or if the transmitter is removed from the vehicle in which it is installed.

The operation of the security control system may optionally be enhanced by making the receiver 20 responsive to a signal transmitted by the transmitter 34.

Assume for example that the security system 32 has detected a breach of security in the building in which the detection system 16 is installed. An appropriate signal is transmitted by the transmitter 34 at regular intervals. When the vehicle comes within range of the transmitted signal then the transmitted signal is received by the receiver 20 and an appropriate "security breach" status signal is displayed on the display 24. The driver of the vehicle is thereby automatically alerted, when the vehicle is within a predetermined range of the building, to the occurrence of the unauthorised event. Alternatively the system 32 is automatically interrogated by the transmitter 18, when the vehicle comes within range of the system and, in response to the interrogating signal, a security status signal is transmitted by the transmitter 34.

It is possible, in addition to displaying the security status signal, and in a manner analogous to what has been described, to inhibit the transmission, by the transmitter 18, of the control signal which is used for initiating operation of the actuator 30.

It is to be understood that the operation of the transmitter 18 may be inhibited when any one or more of a plurality of occurrences take place. Thus the operation of the transmitter may be inhibited if the transmitter is removed from a vehicle, if unauthorised access is obtained to the vehicle, if any other unauthorised event takes place on or in connection with the vehicle, or if an unauthorised event takes place at an installation which is remote from the vehicle.

In a variation of the invention an attempt to operate the transmitter 18 after a designated event has taken place causes the transmission, preferably continuously, of a signal which can be used to identify the location of the transmitter and hence, if the transmitter is still installed in the vehicle, of the location of the vehicle. This enables steps to be taken to recover the vehicle, if it has been stolen.

What is claimed is:

1. A security control system for use with a vehicle comprising: a remote control transmitter for installation into to a vehicle, a receiver which is remote from the vehicle and which, in response to at least one control signal transmitted by the transmitter, causes operation of at least one external device, a monitoring unit for monitoring the vehicle to detect authorized access to the vehicle, and an enabling device which is responsive to the monitoring unit, and wherein the transmitter is disabled unless enabled by the enabling device upon authorized access to the vehicle.

2. A security control system according to claim 1 wherein the monitoring unit monitors the vehicle to detect at least one designated event selected from: an unauthorized event, unauthorized access to the vehicle, and removal of the transmitter from the vehicle and wherein the transmitter is disabled upon detecting at least one said designated event.

3. A security control system according to claim 1 wherein the enabling device, in response to authorized access to the vehicle using a valid key or remote control device, enables the transmitter so that, when required, the transmitter can transmit the at least one control signal to cause operation of the external device.

4. A security control system according to claim 1 wherein the external device is a garage door opener or a gate opener.

5. A security control system for use with a vehicle comprising: a remote first transmitter, a receiver and display module for installation inside the vehicle, the receiver being responsive to the remote first transmitter and being linked to the display module so that information or status received by the receiver can be displayed, and a remote monitoring unit linked to the remote first transmitter for transferring information to the receiver when the monitoring unit detects an event.

6. A security control system according to claim 5 which includes a second transmitter, which is in the vehicle, for transmitting a control signal to a control device and an inhibiting unit and wherein the remote monitoring unit monitors the security status of a designated area and, when the vehicle is within a predetermined range of the designated area, and if the security status has been breached and information on the breach has been transferred to the receiver in the vehicle, the inhibiting unit temporarily inhibits transmission of the control signal.

7. A security control system according to claim 6 wherein, upon inhibition of the transmission of the control signal, the display module displays information on the breach.

8. A security control system according to claim 5 wherein the monitoring unit monitors the security status of a designated area and, upon detection of an unauthorized event, the first transmitter transfers a warning signal to the display module when the vehicle is within a predetermined range of the designated area.

9. A security control system according to claim 6 wherein the monitoring unit is in an alarm system in the designated area.

10. A security control system according to claim 6 wherein the receiver, display module and the second transmitter are functionally integrated in the vehicle.

11. A security control system according to claim 6 wherein the monitoring unit causes transmission of a signal by the first transmitter to the receiver in the vehicle upon receiving a command from the second transmitter in the vehicle.

12. A security control system which includes transmitter means for transmitting a control signal to a remote receiver for activating movement of a door or gate, monitoring means for monitoring at least one installation to detect at least one designated event, signal generating means responsive to the monitoring means, for generating a first signal when a designated event is detected, and inhibiting means, responsive to the first signal, for inhibiting the transmission of the control signal.

13. A security control system according to claim 12 wherein the transmitter means is located in a vehicle, the remote receiver is used to control operation of a garage door opener or a gate opener and the designated event is the locking of doors of the vehicle.

14. A security control system according to claim 13 wherein, when the vehicle's doors are unlocked, through an authorized method, the transmitter means is enabled so that, when required, the transmitter means can transmit the control signal.

15. A security control system according to claim 14 which includes display means, and wherein the monitoring means monitors the security status of a building, the display means, at least when the vehicle is within a predetermined range of the building, providing a display of the said security status.

16. A security control system according to claim 14 wherein the monitoring means monitors the security status of a building and, when the vehicle is within a predetermined range of the building, and if the security status has been breached, the inhibiting means inhibits the transmission of the said control signal.

17. A security control system according to claim 14 which includes display means, and wherein the monitoring means monitors the security status of a building, the display means, at least when the vehicle is within a predetermined range of the building, providing a display of the said security status.

18. A security control system according to claim 13 wherein the monitoring means monitors the security status of a building and, when the vehicle is within a predetermined range of the building, and if the security status has been breached, the inhibiting means inhibits the transmission of the said control signal.

* * * * *